United States Patent [19]

Hoffman

[11] 4,012,041

[45] Mar. 15, 2977

[54] GAME BALL REPRESSURIZING METHOD

[76] Inventor: Allan C. Hoffman, 5876 Republic Ave., Riverside, Calif. 92504

[22] Filed: Oct. 20, 1975

[21] Appl. No.: 623,795

[52] U.S. Cl. ..... 273/61 D; 273/65 D
[51] Int. Cl.[2] ..... A63B 39/04; A63B 41/12
[58] Field of Search ..... 273/65 C, 65 D, 61 R, 273/61 D, 61 B, 61 C

[56] References Cited

UNITED STATES PATENTS

| | | | |
|---|---|---|---|
| 2,176,565 | 10/1939 | Boynton | 273/65 D |
| 2,294,424 | 9/1942 | Roberts | 273/61 R |
| 2,318,115 | 5/1943 | Tubbs | 273/65 C |
| 2,349,463 | 5/1944 | Riddell | 273/65 D |
| 3,098,779 | 7/1963 | Cox | 273/65 C X |
| 3,100,641 | 8/1963 | Nicholls et al. | 273/65 C |

*Primary Examiner*—George J. Marlo
*Attorney, Agent, or Firm*—Herbert E. Kidder

[57] ABSTRACT

An inflatable game ball having an outer shell of rubber or rubber-like elastomer, enclosing a hollow interior space, with an internal self-sealing check valve extending through the shell. The check valve is molded of soft rubber and has a pair of thin flanges or lips, arranged side-by-side, with one or more openings that are opened up to allow air to pass freely into the ball when the air pressure on the outside of the valve is greater than the pressure inside the ball. A hand pump is provided, which has a nozzle that inserts into the outside opening of the check valve, and operating the pump causes air to be pumped into the ball to inflate the latter to the desired pressure. The thin flanges of the check valve are closed tightly against one another by the air pressure within the ball, thereby sealing the valve opening to prevent escape of the air. Tennis balls which have lost their pressure and become dead are restored to like-new condition by drilling a hole through one side of the ball, inserting a check valve insert with adhesive on the sides, and inflating the ball to like-new pressure with a hand pump after the adhesive has set, or cured.

1 Claim, 12 Drawing Figures

FIG. 1.
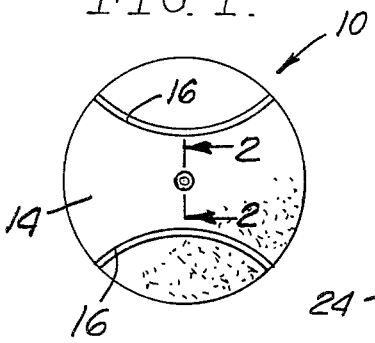
FIG. 2.
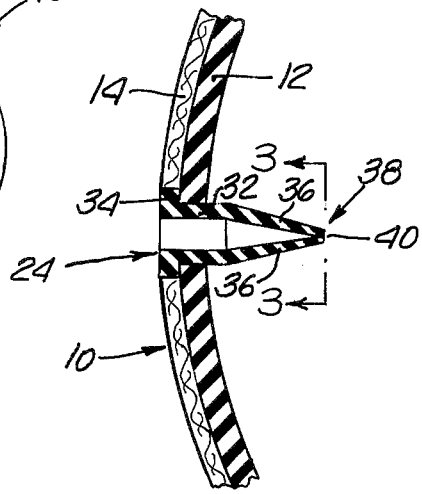
FIG. 3.
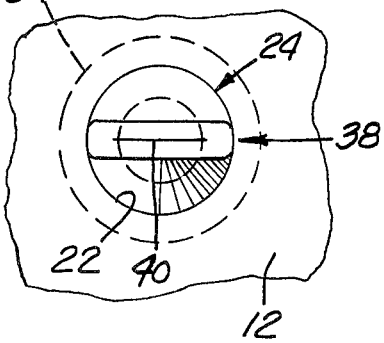
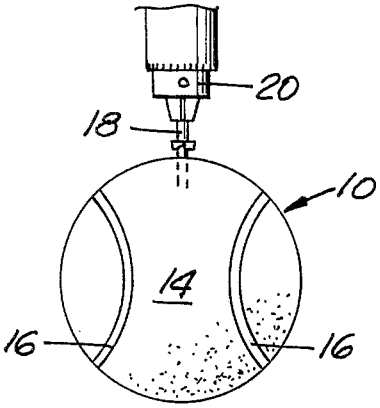
FIG. 4.
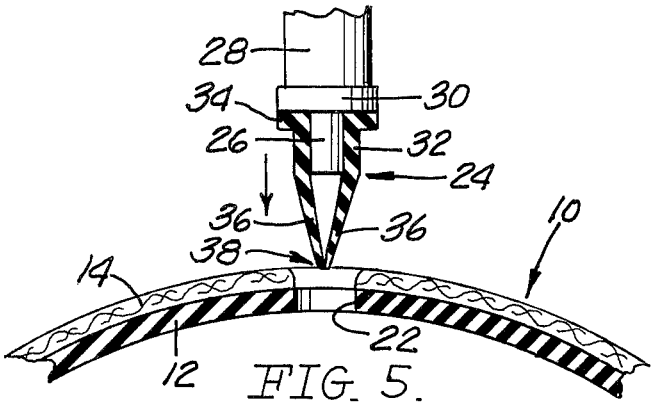
FIG. 5.
FIG. 6.
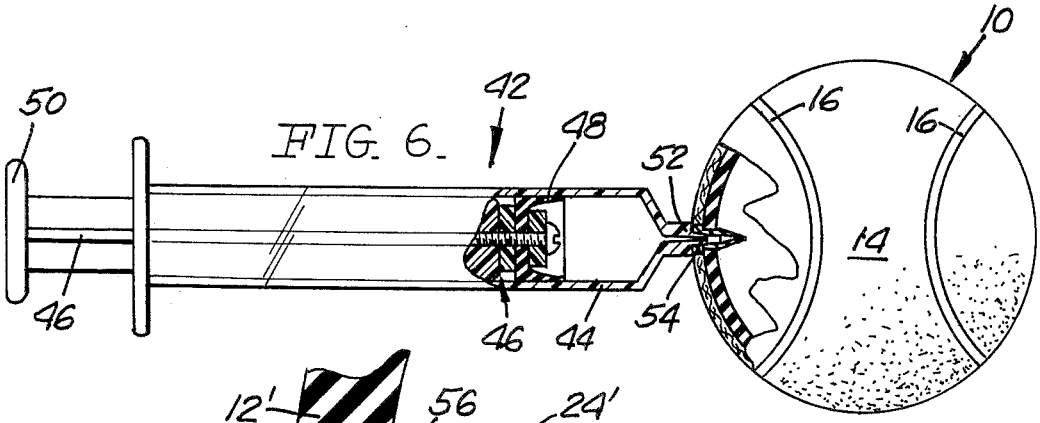
FIG. 7.
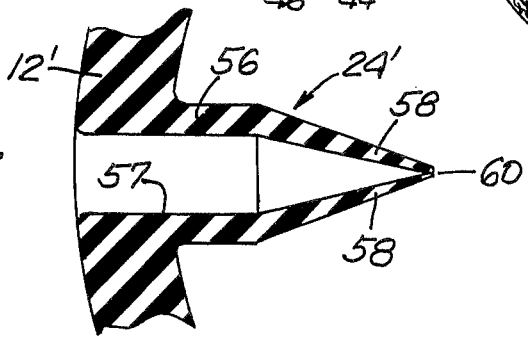

FIG. 8.
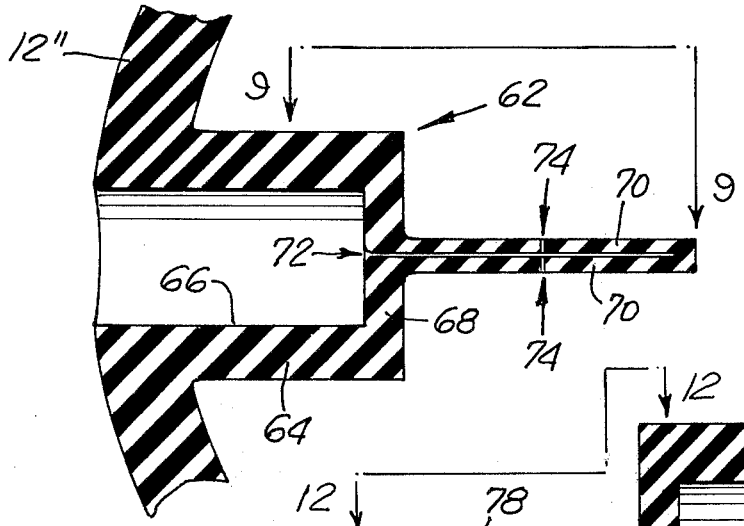
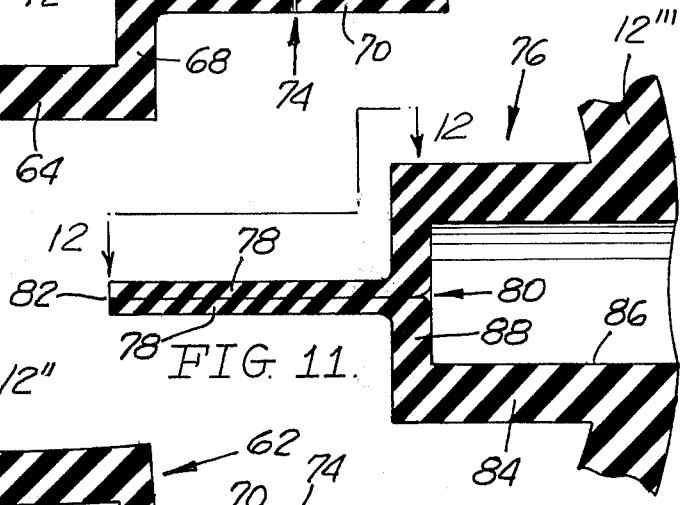
FIG. 11.
FIG. 10.
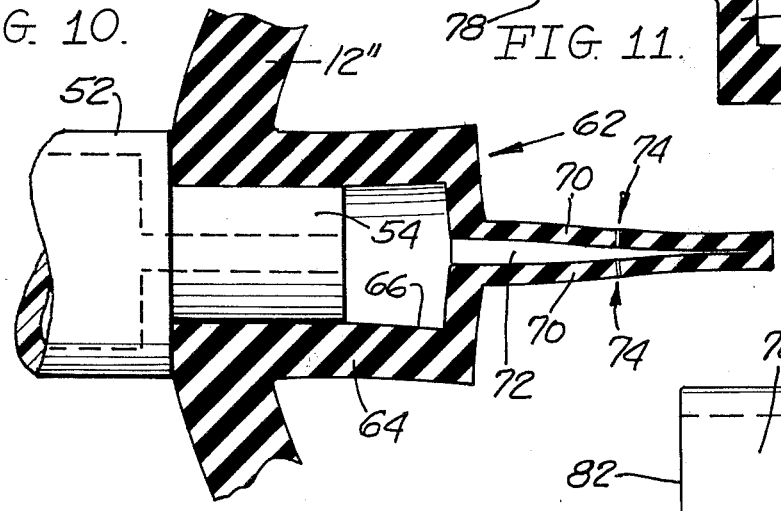
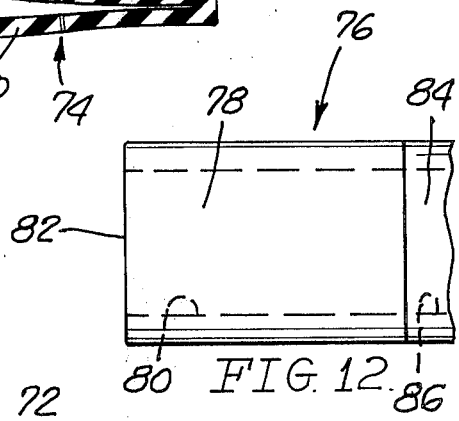
FIG. 12.
FIG. 9.
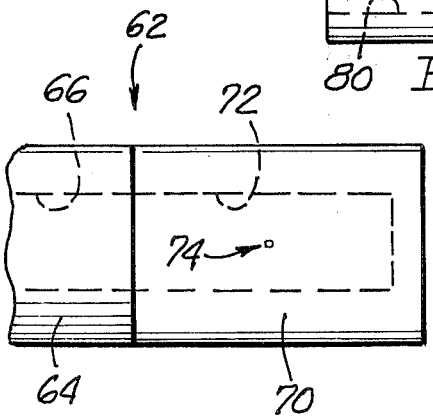

GAME BALL REPRESSURIZING METHOD

BACKGROUND OF THE INVENTION

The present invention pertains to a new and improved inflatable game ball, and to a method of repressurizing balls, such as tennis balls, which have lost some or all of their internal air pressure and become dead.

Certain types of game balls, exemplified by tennis balls and racket balls, are made with relatively thin rubber shells which are inflated by air pressure to several pounds per square inch, which gives them a lively bounce and action that makes for a fast game. However, air leaks slowly through the rubber, and in time the ball will become almost totally deflated. In most cases, air leakage is by diffusion through the molecular spaces in the rubber, and the amount of leakage is primarily a function of the time that has elapsed since the pressurized can that the ball was shipped in was opened. Thus, a brand new tennis ball or racket ball that has been used only once or twice and then set aside for a few weeks may be considerably softer, and somewhat dead, when used again in play. Tennis balls are fairly expensive, and the cost becomes an objectionable item when a item when a ball goes dead after being used only a few times.

Another item is that brand new tennis balls rarely have the exact same bounce. Sometimes, a brand new ball will have so little bounce that it cannot be used at all. Bounce is determined by dropping the balls from a given height. Ideally, all brand new balls dropped from a given height should bounce up to the same level, but this is seldom the case. As a result, when players use one ball after another, the action of the ball becomes unpredictable, and players have difficulty in controlling their shots.

SUMMARY OF THE INVENTION

The primary object of the present invention is to provide a new and improved inflatable game ball which can be inflated or repressurized to any desired pressure by the player, so that the player can continue to maintain the liveliness, or bounce, of the ball at a consistently high level, regardless of the time that has elapsed since the ball was first put into use.

Another important object of the invention is to provide a method and means for restoring dead tennis balls or racket balls to like-new condition, with the internal air pressure restored to its original level.

These objects are achieved in the present invention by providing a specially designed check valve, which may be molded integrally with the rubber shell of the ball, or added later by drilling a hole in the shell and inserting a small valve insert. The check valve is molded of soft rubber and is characterized by having two opposed, thin flanges or lips, that part to allow air to enter when the outside pressure is greater than the internal pressure. When the ball has been pumped up to the desired inflation pressure, the internal pressure presses the thin flanges against one another so as to seal the valve against escape of air. In the case of the method of restoring dead tennis balls, a small hole is drilled through the felt cover and rubber shell, and a valve insert is pressed into the hole, with adhesive applied to the sides of the insert. When the adhesive has set, or dried, the valve becomes firmly attached to the ball as though molded integrally with the shell.

Other objects and advantages of the invention will become apparent to those skilled in the art from the following detailed description of the preferred embodiment thereof, taken with the accompanying drawings.

BRIEF DESCRIPTION OF THE DRAWINGS

FIG. 1 is an elevational view of a tennis ball having an inflation valve in accordance with the present invention;

FIG. 2 is an enlarged fragmentary cross-sectional view taken at 2—2 in FIG. 1;

FIG. 3 is a fragmentary end view of the inflation valve, as seen from 3—3 in FIG. 2;

FIG. 4 is an elevational view of a tennis ball being drilled to receive an inflation valve insert;

FIG. 5 is an enlarged fragmentary sectional view, showing the inflation valve insert being inserted into the hole in the tennis ball;

FIG. 6 is partially cut-away view, showing the tennis ball being inflated by a hand pump having a nozzle that is inserted into the valve;

FIG. 7 is a fragmentary sectional view of an inflation valve molded integrally with the rubber shell of the ball;

FIG. 8 is a fragmentary sectional view of another embodiment of the inflation valve of the invention;

FIG. 9 is a fragmentary elevational view of the same, as seen at 9—9 in FIG. 8;

FIG. 10 is a view similar to FIG. 8, but showing the thin flanges of the valve spread apart by air pressure, thereby uncovering the holes through which air enters the ball;

FIG. 11 is a fragmentary sectional view through another embodiment of the inflation valve; and FIG. 12 is a fragmentary elevational view as seen at 12—12 in FIG. 11.

DESCRIPTION OF ILLUSTRATED EMBODIMENTS

In FIGS. 1 to 6 of the drawings, a tennis ball is designated in its entirety by the reference numeral 10, and comprises a molded rubber shell 12 covered with a felt cover 14. The conventional tennis ball is manufactured without an inflation valve, and the shell 12 and cover 14 are completely imperforate; the only visible marks being the seams 16 of the cover.

Tennis balls are pressurized at the factory, and are packed in sealed containers that are also pressurized, so that as long as the containers remain unopened, the air pressure is substantially the same in the container on the outside of the ball as it is on the inside. As soon as the container is opened and the balls are exposed to atmospheric pressure, the air under pressure within the balls begins to leak out, and after a period of time, the ball becomes dead and is no longer usable.

In accordance with the invention a dead tennis ball may be restored to its original like-new pressure by first drilling a small hole 22 through the cover 14 and shell 12, about ⅛ inch in diameter, as shown in FIG. 4, using a drill bit 18 in the chuck 20 of a bench drill. An inflation valve insert 24 is then inserted into the hole 22, as shown in FIG. 4, with the insert mounted on the pin 26 of an arbor press 28. The arbor press 28 has a shoulder 30 that bears against the top end of the valve insert 24, and when the arbor press 28 moves downwardly, as indicated by the arrow, the insert is pressed into the hole 22, where it remains when the arbor press is retracted.

The valve insert 24 is a small molded part made of soft rubber, with a hollow cylindrical barrel 32 having a radial flange 34 at its top end. The bottom end of the cylindrical barrel 34 becomes wedge-shaped, with two opposed, converging flanges, or lips 36, which come together at 38. There is a slit 40 at the convergence of the flanges 36, which is normally closed, but which can be opened by air pressure when the outside pressure is greater than the pressure inside. When the tennis ball has been inflated to its usual pressure of 10 to 12 psi, the air presses the sealing lips 36 together, against one another, tightly sealing the slit 40. The extremely soft, resilient sealing lips 36 are pressed tightly together in good sealing contact even at the relatively low pressure of 1 to 4 psi used in racket balls.

At the time the valve insert is prepared for insertion into the hole 22, a coating of adhesive is applied to the outer surface of the cylindrical barrel 32, and when the insert has been pressed into place, the adhesive dries, or sets, thereby cementing the insert firmly to the shell 12. The barrel 32 is also made slightly larger in diameter than the hole 22, so that the insert is a force fit in the hole. As best shown in FIG. 2, the flange 34 is the same thickness as the felt cover 14, so that there is no projection above the surface of the felt to interfere with the bounce of the ball.

With the inflation valve insert 24 cemented in place, the tennis ball is ready to be inflated. For repressuring balls, a hand pump 42 may be used, as shown in FIG. 6. Hand pump 42 may take any desired form, but is herein shown as comprising a plastic cylinder 44, in which a plunger 46 is slidably disposed. Plunger 46 has a cup-shaped, resilient piston 48 fixed to its inner end. Plunger 46 projects from the left-hand end of the cylinder 44, as viewed in FIG. 6, and has a handle knob 50 on its outer end. The right-hand end of cylinder 44 is reduced in diameter to form a nose piece 52, which terminates in a small-diameter cylindrical nozzle 54 that fits snugly into the hollow bore of the valve insert 24.

With the nozzle 54 inserted into the bore of the valve insert 24, as shown in FIG. 6, plunger 46 is pushed inwardly, causing the cup-shaped piston 48 to force air into the tennis ball through the valve. Plunger 46 may then be retracted (i.e., to the left) and the resilient skirt of piston 48 flexes inwardly to allow air to flow into the bottom end of the cylinder from the top end thereof. After 3 or 4 pumps of the plunger 46, the tennis ball will be pumped up to an inflation pressure equal to the pressure it had when brand new.

If desired, a pressure gauge can be connected into the output end of the pump 42 so that the inflation pressure can be observed as the ball is being pumped up. This allows any number of tennis balls to be inflated to exactly the same pressure, which is something that is seldom, if ever, obtained with brand new balls of conventional type. It has been determined accurately that a variation of only .5 psi in the ball pressure makes the difference between a good bouncing ball and a poor one. Moreover, ball pressure can be adjusted for altitude, whereas today special balls are made for such places as Denver, at altitudes of 5000 feet or so.

FIG. 7 shows another embodiment of the invention. In this instance, the inflation valve 24' is molded integrally with the rubber shell 12'. The rubber shell 12' may be covered with a felt cover if the ball is a tennis ball, or it may be left uncovered if the ball is a racket ball. The inflation valve 24' is essentially the same as the valve insert of FIGS. 1–6, in that it comprises a cylindrical barrel 56, with a central bore 57 and converging sealing lips 58 which come together and are separated by a slit 60 at the extreme end.

A ball made with an integral inflation valve 24' can be inflated at the factory by merely placing it in a pressure container, wherein the pressure is built up to the desired inflation pressure. With the pressure on the outside of the ball greater than the pressure on the inside, the sealing lips 58 will be spread apart slightly by air pressure, opening the slit 60 and allowing air to enter the ball. As soon as the inside and outside pressures are equalized, the sealing lips 58 will close the slot 60 to prevent any escape of air.

FIGS. 8, 9 and 10 show another embodiment of the inflation valve used in the present invention. In this case, the valve is designated by the reference numeral 62 and comprises a cylindrical barrel 64 which is molded integrally with the rubber shell 12''. Barrel 64 has a central bore 66 which terminates at an end wall 68. Projecting inwardly toward the center of the ball from end wall 68 are two thin sealing lips 70 which are separated from one another for most of their length by a slit 72. At their outer ends and along their side edges, the sealing lips 70 are joined together, as best shown in FIG. 9. Midway between their ends, the sealing lips 70 are pierced by very small diameter holes 74, which provide the entrance through which air is admitted into the ball.

When the valve 62 is relaxed, with equal pressure inside and out, the sealing lips 70 may be in contact with one another, or they may be spaced very slightly apart, as shown in FIG. 8. However, as soon as the pressure inside the ball exceeds the outside pressure, sealing lips 70 are pressed tightly together by the air pressure, and holes 74 are sealed. Inserting the nozzle 54 of the air pump into the bore 66 and actuating the pump causes the higher pressure to balloon the inner end of the barrel 64 slightly, as shown in FIG. 10, spreading the sealing lips 70 apart slightly and exposing the holes 74 so that air can pass into the interior of the ball.

Still another form of the invention is shown in FIGS. 11 and 12, and is designated by the reference numeral 76. This embodiment is similar to that shown in FIGS. 8–10, except that the sealing lips 78 are separated from end to end by a slit 80, which opens at 82 into the interior of the ball. As in the preceding embodiment, valve 76 has a cylindrical barrel 84 molded integrally with the rubber shell 12''', and formed within the barrel is a central bore 86. The bore 86 terminates at an end wall 88, from which the sealing lips 78 project inwardly toward the center of the ball.

When the ball is pressurized internally, the sealing lips 78 are pressed tightly together by air pressure, sealing the slit 80 so that air cannot escape. However, when the pressure inside the bore 86 exceeds the pressure within the ball, as when the pump 42 is being used, sealing lips 78 readily open to allow air to enter the ball.

Each of the several inflation valve embodiments shown herein can be made as an insert, to be inserted into a hole drilled in the ball, as in FIGS. 4 and 5, or molded integrally with its rubber shell. The inflation valves are applicable to all ball types using compressed air or other gas to create bounce, and are particularly suitable for tennis balls and racket balls. The weight of the valves is negligible, being only about 0.02 grams.

For the first time, the internal pressure within an inflated game ball can be adjusted, measured and maintained on an accurate basis, even to the extent of using a mercury manometer to measure the pressure, if desired. If it should be necessary to reduce the inflation pressure, all that is necessary is to insert a tooth pick or paper clip into the valve opening, so as to spread the sealing lips apart and break the seal. The adjusted pressure can be set to an accuracy of plus or minus a fraction of an inch of mercury. The inflation valve of the invention is simple and inexpensive to manufacture, and one important feature of the valve is that the sealing lips are located remote from the areas of distortion caused by play. As a result, the valve will withstand a great deal of distortion of the rubber shell without breaking its seal. Other valves that have been tried break their seal when the ball is hit hard.

Pressure can be introduced through the inflation valves of the invention either with a simple hand pump, or the balls can be almost instantly pressurized in large lots in a pressure chamber, with all of the balls being at the same pressure and not varying widely, as is now true of the present method of making such balls.

The balls do not have to be packaged in pressure containers for shipment or storage. If they have lost any pressure, it can be restored in a manner of seconds with a simple pocket size hand pump. By repressurization of tennis balls when they have started to lose their bounce, it is possible to extend the useful life of a tennis ball until the felt cover has become so worn that the ball is no longer playable.

While I have shown and described in considerable detail what I believe to be the preferred forms of the invention, it will be understood by those skilled in the art that the invention is not limited to such details, but may take various other forms within the scope of the following claims.

What I claim is:

1. The method of repressurizing a dead inflatable game ball having an imperforate hollow rubber shell, comprising the steps of:

1. drilling a hole through the rubber shell, using a tool that removes material and leaves a cylindrical hole in the shell;
2. inserting an inflation check valve of soft resilient rubber into the hole, said check valve having a cylindrical barrel portion that fits snugly into the hole, and said barrel portion terminating in a wedge-shaped configuration formed by two opposed, converging, sealing lips that come together separably along a line of contact at their inner extremities to open the valve and seal the valve against escape of air when the pressure inside the ball exceeds atmospheric pressure;
3. securing the check valve in place, so that it will not be dislodged during violent play; and
4. forcing air through the inflation check valve whereby said lips separate at said line of contact and air passes into the interior of the ball.

* * * * *